US005639129A

United States Patent [19]

Lindley

[11] Patent Number: 5,639,129

[45] Date of Patent: Jun. 17, 1997

[54] DOOR LATCH AND SEALING MECHANISM FOR WASTE CONTAINERS

[75] Inventor: Roger R. Lindley, Yukon, Okla.

[73] Assignee: McClain Industries of Oklahoma, Oaklahoma City, Okla.

[21] Appl. No.: 425,869

[22] Filed: Apr. 20, 1995

[51] Int. Cl.[6] ..... E25C 1/04

[52] U.S. Cl. ..... 292/145; 292/240; 292/340; 292/341.13; 220/1.5; 220/324

[58] Field of Search ..... 292/145, 150, 292/151, 153, 154, 218, 240, 241, 340, 341.13, DIG. 70; 220/1.5, 323, 324, 308, 344

[56] References Cited

U.S. PATENT DOCUMENTS

| | | | |
|---|---|---|---|
| 1,566,997 | 12/1925 | Taggart, Jr. | 292/341.13 X |
| 2,728,971 | 1/1956 | Harter | 292/240 X |
| 2,834,504 | 5/1958 | Annicq | 292/240 X |
| 2,861,830 | 11/1958 | Bennett | 292/240 |
| 3,099,473 | 7/1963 | Pastva, Jr. | 292/240 |
| 3,281,177 | 10/1966 | Tenenbaum | 292/340 |
| 3,329,456 | 7/1967 | Olander | 292/340 X |
| 3,706,392 | 12/1972 | Sprick et al. | 220/38 |
| 3,825,289 | 7/1974 | Armstrong | 292/341.13 X |
| 4,157,146 | 6/1979 | Svenson | 220/324 |
| 4,545,523 | 10/1985 | Galbreath et al. | 232/43.1 |
| 4,643,331 | 2/1987 | May | 220/324 |
| 4,821,902 | 4/1989 | May | 220/1 T |
| 4,934,562 | 6/1990 | Early et al. | 220/1.5 |
| 5,022,691 | 6/1991 | Clay, Jr. | 292/341.13 X |
| 5,251,775 | 10/1993 | Kruzick et al. | 220/331 |
| 5,269,586 | 12/1993 | Hahn et al. | 292/240 X |
| 5,299,844 | 4/1994 | Gleason | 292/240 |

FOREIGN PATENT DOCUMENTS

| | | | |
|---|---|---|---|
| 2534305 | 4/1984 | France | 292/341.13 |
| 433929 | 9/1926 | Germany | 292/DIG. 70 |
| 496694 | 4/1930 | Germany | 292/341.13 |
| 341207 | 11/1929 | United Kingdom | 292/DIG. 70 |

OTHER PUBLICATIONS

*Sludge Containers,* 8–page glossy brochure, 1993 McClain Industries, Inc., MC–1049.

*International Containers,* 4–page glossy brochure, 1993 McClain Industries, Inc., MC–1057.

*Galbreath,* 3–page brochure, Intermodal Container, 1992.

McClain Prior Art Door Latch, 1–page schematic, McClain of Oklahoma.

*Primary Examiner*—Suzanne L. Dino

*Attorney, Agent, or Firm*—Niro, Scavone, Haller & Niro

[57] ABSTRACT

A door latch and sealing assembly associated with a waste container having an open end and at least one door positioned adjacent to and overlying the open end. The assembly includes a tapered seal actuator, and a seal actuator drive mechanism associated with the seal actuator and adapted to drive the seal actuator. A receiver is rigidly attached to the container and is adapted for operable engagement with the seal actuator. An elastomeric gasket is positioned between the open end and the door. In operation, extension of the seal actuator drive mechanism causes the seal actuator to engage the receiver; the receiver then reactively imparts to the seal actuator a compressive force on the door sufficient to establish a liquid-tight or hermetic seal.

21 Claims, 4 Drawing Sheets

DOOR LATCH AND SEALING MECHANISM FOR WASTE CONTAINERS

BACKGROUND OF THE INVENTION

The present invention relates to the field of waste containers and, more specifically, to a waste container with a door latch assembly for locking and sealing a door against the container.

The problem of waste handling, waste transport and disposal has become increasingly urgent in our highly industrialized society. Liquid and solid wastes of all kinds, both toxic and nontoxic, are generated by industrial plants, hospitals, laboratories, mining operations and consumers. These materials are accumulated in extremely high volume and must be handled, transported and disposed of without undue risk to the public health and safety, or to handling personnel.

Hazardous waste is frequently transported to disposal sites in large waste containers. These waste containers are typically subject to rough handling and must therefore be of a sturdy construction. During normal use some damage or misalignment of closure members and their associated seals inevitably occurs. This can result in leakage of the container during stationary use or transport, with consequent risks, or costly down-time while the container is being repaired.

Waste disposal is typically accomplished by dumping the waste container contents at an appropriate disposal site. Dumping occurs by opening a rear door at one end of the waste container, raising the other end of the container and permitting the waste to slide through the open rear door. Releasing the seal on the door, even while the container is level, can result in a seepage of contents, particularly when an inner bag liner is not used.

Waste containers within the field of the present invention may be designed for rail transport (intermodals) or for road transport by vehicles equipped with roll-off hoists (roll-off containers). With either container design, the door latching and sealing mechanisms must be constructed to withstand the considerable internal forces generated against the door by the waste within the container. Due to the presence of potentially hazardous waste, the door must also be latched in a manner that will not permit it to be accidentally opened. For a given application (for example, the transportation of liquid sludge), the door latch must typically provide a liquid-tight seal of the door against the container. Also, since government regulations currently limit the fume emissions from containers carrying certain hazardous waste laden with benzene, toluene and other toxic substances, an air-tight (hermetic) door seal may be required in certain applications.

A typical waste container might be about 20 feet long, about 6–8 feet wide, and about 4–7 feet high, although larger or smaller containers are used, and may contain as much as 2000–6000 gallons or more of liquid waste, such as sludge. Since there are 8.4 pounds in each gallon of water, it will be appreciated that as much or more than 20,000–50,000 pounds of liquid waste can be contained in a single waste container. Also, the liquid waste is a moving, dynamic load. As the container stops and starts (as occurs with either rail or vehicle transport), the liquid waste will tend to move back and forth between the front and the rear of the container. During this movement, the maximum flow velocity of the liquid waste will occur in the middle section of the container, as the boundary layers at the floor, roof and sidewalls of the container are areas of zero flow velocity. Therefore, the middle section of the rear door will be the area in which the greatest outward force generated by the hydrostatic pressure of the moving liquid waste against the door will be concentrated. This can cause the rear door, and particularly the center portion of the rear door, to bow outwardly during container transport, unless it is prevented from doing so.

Due to the large door size associated with waste containers which are the subject of this invention, it has been found that multiple door latch mechanisms may be required at each opposing door end adjacent the container sidewalls, and at middle or intermediate sections along the door. Also, due to applicable rail and vehicular transport regulations which narrowly constrain both container size and the size of devices which may outwardly extend from the containers, door latch mechanisms typically must be provided which can be stored closely adjacent to the container sides during transport.

The door latch mechanism must also be highly reliable since the environmental and legal consequences of allowing hazardous waste to leak through an unsealed door can be severe. For this reason, chains or a simple over-center latching mechanism are not desirable, since such latch mechanisms can be accidentally opened.

Known door latch and sealing mechanisms, such as those disclosed in U.S. Pat. No. 4,643,331 to May and U.S. Pat. No. 4,545,523 to Galbreath, are relatively complicated and can be difficult for the operator to use.

Therefore, there is a need for a relatively simple door latch and sealing mechanism which can provide a reliable liquid-tight or hermetic door seal in a variety of transport or weather conditions, which is easily used and maintained, and which can be adjusted to control the tightness of the door seal.

SUMMARY OF THE INVENTION

The present invention preserves the advantages of known door latch mechanisms associated with waste containers. In addition, it provides new advantages not found in currently available door latch mechanisms associated with waste containers, and overcomes many of the disadvantages of currently available devices.

The invention is generally directed to a door latch and sealing assembly associated with a waste container which includes unique structural features that facilitate the use of the assembly under various loading conditions, and during various transportation and weather conditions. The invention also addresses the need for a simple yet effective design which is user-friendly, and which provides the ability to adjustably control the tightness of the door seal. The unique arrangement of structural features comprising the invention also reduces the cost of manufacture as compared to many currently available devices.

In one preferred embodiment, the door latch and sealing assembly of the present invention is associated with a waste container having a floor, two opposing sidewalls, and an open end defined by a continuous edge portion. The waste container also includes at least one rear door positioned adjacent to and completely overlying the open end. The door latch and sealing assembly includes at least one seal actuator, and at least one associated seal actuator drive mechanism adapted to drive the seal actuator. A receiver is attached to the container and operably engages the seal actuator. A continuous elastomeric gasket is positioned between the edge portion of the open end and the door. The gasket is capable of forming a liquid-tight door seal upon the application of a sufficient compressive force to the door in the direction of the open end. The compressive force on the door necessary to form the liquid-tight seal of the door against the container is generated by extension of the seal actuator drive mechanism, which causes the seal actuator to engage the receiver. The receiver, which is rigidly connected to the container, then imparts a reactive, compressive force on the seal actuator sufficient to form the liquid-tight seal. Further extension of the seal actuator drive mechanism can also provide a hermetic seal of the door.

In another feature of this embodiment, the seal actuator is tapered.

In a further feature of this embodiment, the gasket is composed of a compressible neoprene sponge.

In a further feature of this embodiment, the seal actuator drive mechanism includes means, such as a turnbuckle, for adjustably controlling the tightness of the door seal.

In an alternative embodiment, the seal actuator and the receiver can be positioned on the inside of the container.

BRIEF DESCRIPTION OF THE DRAWINGS

The novel features of the invention are set forth in the appended claims. The invention itself, however, together with further objects and attendant advantages, will be best understood by reference to the following desciption taken in connection with the accompanying drawings, in which reference numerals represent like elements in the several views, and in which:

DETAILED DESCRIPTION OF THE PREFERRED EMBODIMENTS

Figure 1:
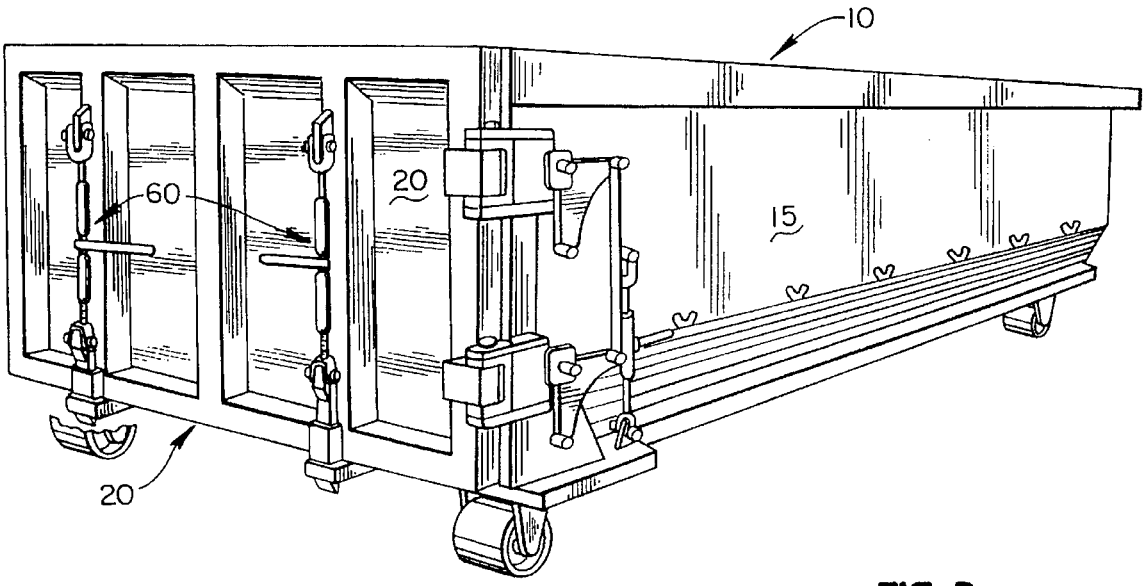
FIG. 1 is a perspective view of a roll-off waste container utilizing the door latch and sealing assembly of the present invention.

Referring to FIG. 1, a roll-off waste container, designated generally as 10, is shown. Roll-off container 10 is adapted to be carried on a transport vehicle equipped with a roll-off hoist mechanism (not shown), and can be dropped off at a waste site or emptied at the waste site and readied for another load. Waste container 10 may carry a variety of waste materials, which can include solid, liquid and gaseous components.

In normal use, container 10 is heavily loaded, often carries active chemical materials, and can undergo rough handling in harsh weather conditions. Accordingly, it is constructed of heavy gauge sheet metal, preferably steel plate, and heavily reinforced by structural members to enhance its strength. Container 10 includes a floor 13, a pair of sidewalls 15, a front wall (not shown) and rear door 20. A lid or roof (not shown) can be constructed from a variety of materials, such as aluminum or hard plastic, or a tarpaulin or other fiber or plastic cover can be used. For example, lids of the roll-top, over-under, roll-over, spring-assisted, and fiberglass variety can each be used, and can find advantageous use with the waste container and door latch assembly of the present invention. Of course, for use with the present invention, where the door seal is required to be liquid-tight or air-tight, the lid seal against the container will typically need to be of a similar quality seal.

Figure 2:
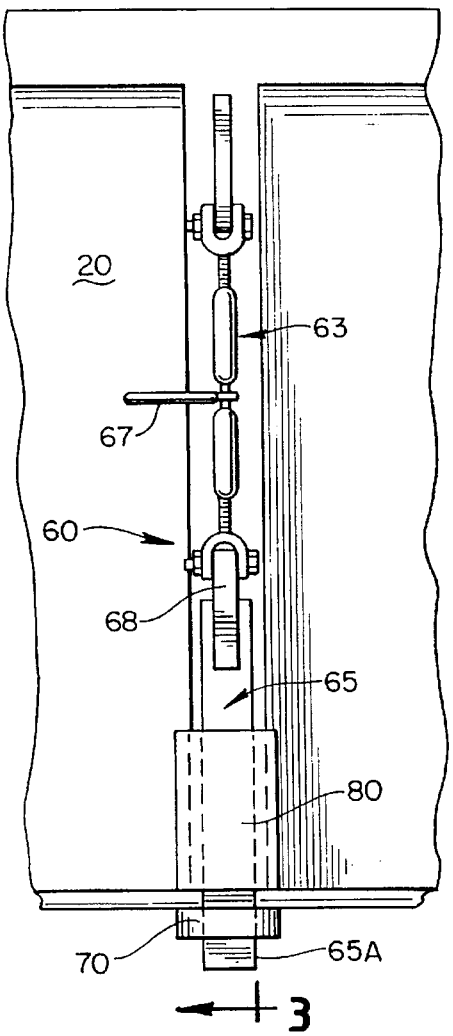
FIG. 2 is a partial, enlarged front view of FIG. 1, more clearly illustrating the door latch and sealing assembly of the present invention.
Figure 3:
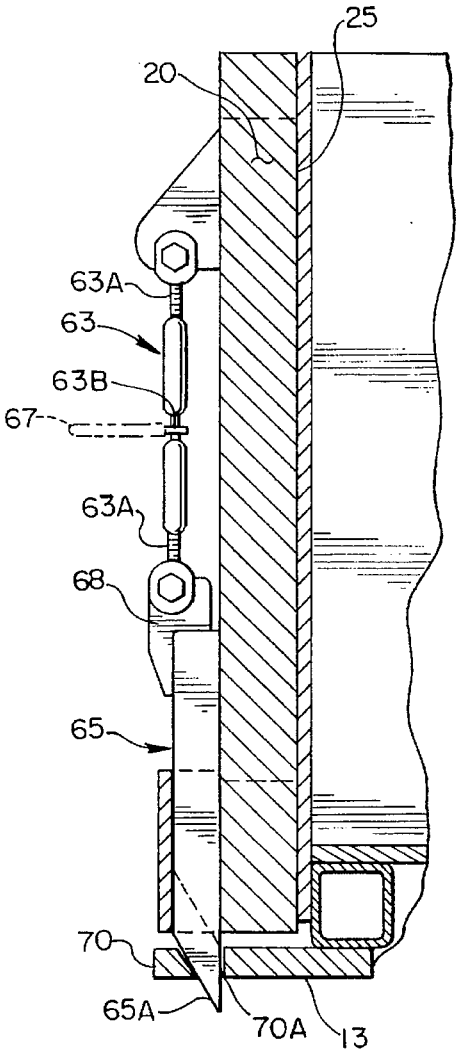
FIG. 3 is a cross-sectional view taken along section line 3—3 of FIG. 2.

Referring to FIGS. 1–3, a preferred embodiment of the sliding door latch and sealing assembly of the present invention, designated generally as 60, will now be described. Sliding door latch and sealing assembly 60 includes ratchet-type turnbuckle 63, which operates as a drive mechanism for seal actuator 65. Seal actuator 65 includes a distal end portion 65A, which is preferably tapered, as shown in FIGS. 2 and 3. A compressible elastomeric gasket or sealing material 25 is adhesively attached to door 20. When door 20 is shut, gasket 25 continuously covers outer edge 30 (shown in FIG. 8), which circumscribes the rectilinear opening formed by waste container 10 when door 20 is open.

Door latch and sealing mechanism 60 shown in FIGS. 1–3 is actuated as follows. First, crank arm 67 of turnbuckle 63 is rotated, causing turnbuckle 63 to be extended. Seal actuator 65, which is rigidly connected to turnbuckle 63 by plate 68, now moves downward in a linear direction. Next, receiver 70, which can be a steel plate extending from the lower portion of container 10 and having an aperture 70A positioned directly below seal actuator 65, accepts distal end 65A as it is downwardly extended. Further downward movement of seal actuator 65 causes the angled portion of distal end 65A to push against the corresponding angled portion of receiver 70. Receiver 70 now exerts a horizontal reactive force against distal end 65A, causing door 20 to move horizontally toward the container, and compressing gasket 25. Guide or housing 80, securely constructed of steel plate and rigidly attached to door 20, permits seal actuator 65 to slide within guide 80 while stabilizing seal actuator 65 and preventing it from buckling during operation.

A sufficient extension of turnbuckle 63 therefore allows door 20 to be sealed against container 10, providing a liquid-tight door seal. Further incremental extensions of turnbuckle 63 can also provide a hermetic door seal, if the manufacturing tolerances, fittings and material compositions of the door, gasket, and latching mechanism are constructed to permit this.

Figure 6:
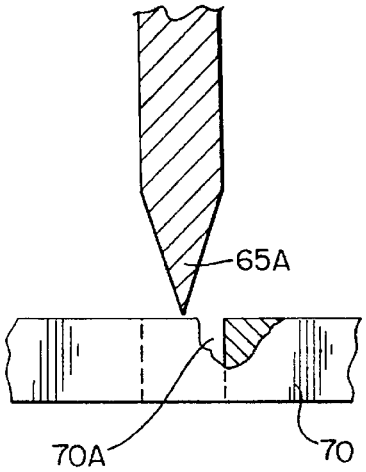
FIG. 6 is an enlarged view of the distal portion of another alternative embodiment of the seal actuator of the present invention.

While seal actuator 65 need not be tapered to operate, this is preferred. Distal portion 65A of seal actuator 65 may have geometrical configurations that are tapered other than that shown in FIG. 3, such as the rounded or pointed configurations shown in FIGS. 6 and 7. "Tapered," as used here, means a geometrical configuration in which at least one side of the distal end portion of the seal actuator decreases in cross-section toward its distal end.

One preferred gasket adhesive for bonding gasket 25 to door 20 is FASTBOND® 10 neutral contact adhesive brushable, manufactured by 3M Corporation of St. Paul, Minn. This adhesive has been found to be sufficiently strong and flexes with the expansion or contraction of the gasket and the container during temperature fluctuations.

A preferred gasket material is a neoprene sponge known as "N-S-10-P, available from Universal Rubber & Plastics Corporation of Tallmadge, Ohio. This neoprene sponge has been tested for a variety of physical parameters such as compression, deflection, brittleness and ozone resistance, and has yielded satisfactory results, as shown:

| | RESULTS |
|---|---|
| COMPRESSION/DEFLECTION | |
| Test Method: ASTM, D1056 3/4" Diameter Specimens Deflected 25% at 0.5 inch per minute. Load required to deflect specimens 25% PSI | 15.5 |
| COMPRESSION SET | |
| Test Method: ASTM, D 395, Method 8 Twenty-two Hours at 158° F., 25% deflection and 1/2 hour recovery, Compression Set Percentage: | 43.5 |
| HEAT-AGED COMPRESSION DEFLECTION | |
| Test Method: ASTM, D 865, D 1056 Specimens Deflected 25% at 0.5 inch per minute. Change in load to deflect specimens 25% PSI 7 days at 158° F. | +12.9 |
| DIMENSIONAL STABILITY | |
| Test Method: ASTM, D 865 Specimen Aged 70 Hours at 212° F. in a forced-air oven. | Width Change % 8.6 Length Change % 5.2 |
| OZONE RESISTANCE | |
| Test Method: ASTM, D 1149 Test Specimens per ASTM, D 518, Method A. Specimens Exposed for 72 hours PPHM at 104° F., 40% Elongation: Hours of Exposure: 72 | 0 |
| LOW TEMPERATURE BRITTLENESS | |
| Test Method: ASTM, D 412, DIE C. Specimens Aged Five Hours at Minus 40° F. in air | No cracks |
| WATER ABSORPTION | |
| Eighteen inch specimens immersed for a period of 24 hours at 73° F. in distilled water. Weight change percentage as follows: | +0.7 |
| FLAME PROPAGATION | |
| One and one-half inch flame height. One minute flame application. (UL Spec.) | 0.5 |
| FLAME RESISTANCE | |
| One and one-half inch flame height. One minute flame application. (UL Spec.) | Pass |
| MIGRATION STAINING | |
| Test Method: ASTM D 925, Method B. Specimens exposed for 48 hours at a 10 inch distance from 275w, type S 3018, Test Surface: White Automotive | Non-Staining |

-continued

| | RESULTS |
|---|---|
| FLUID AGING | |
| Test Method: ASTM D 471 70 hrs. at Room Temperature #3 oil immersion a dimensional change length = | .102% |
| Width = | 1.47% |
| Thickness = | 5.78% |

The door latch and sealing mechanism of the present invention can be utilized in conjunction with any conventional door latch mechanisms, two of which will now be described. These conventional door latch mechanisms can be used, for example, to limit door deformation at the sides of the door adjacent the container sidewalls, while the door latch and sealing mechanism of the present invention can be positioned at intermediate or center locations on the door (where door deformation is greatest).

Figure 8:
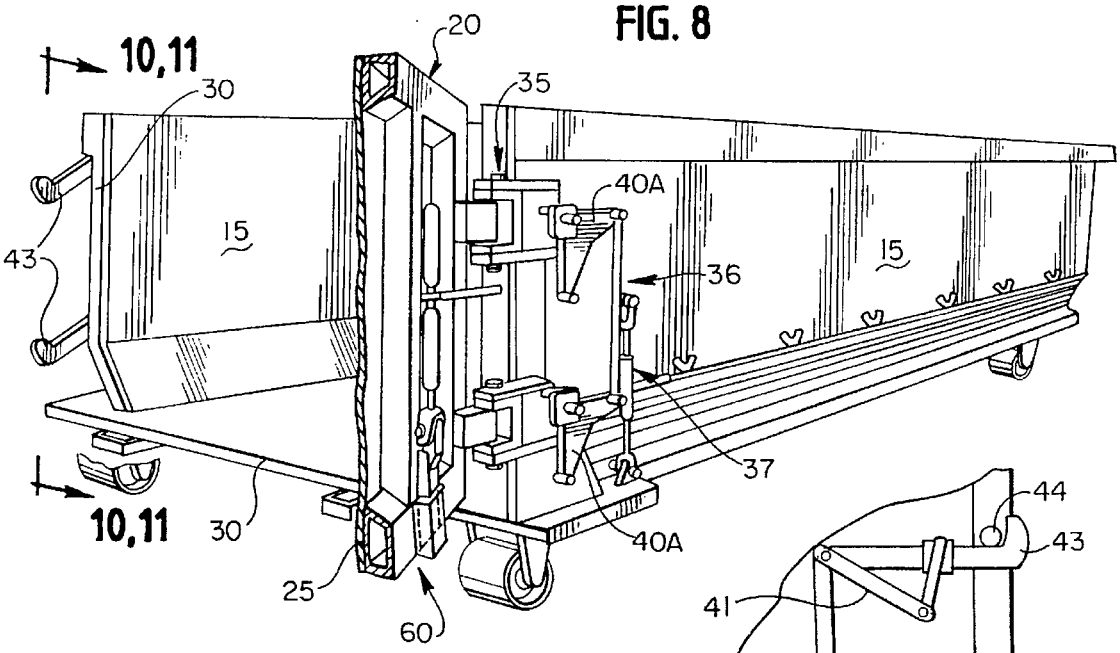
FIG. 8 is a perspective view of the waste container of FIG. 1 illustrating the door in an open position.
Figure 9:
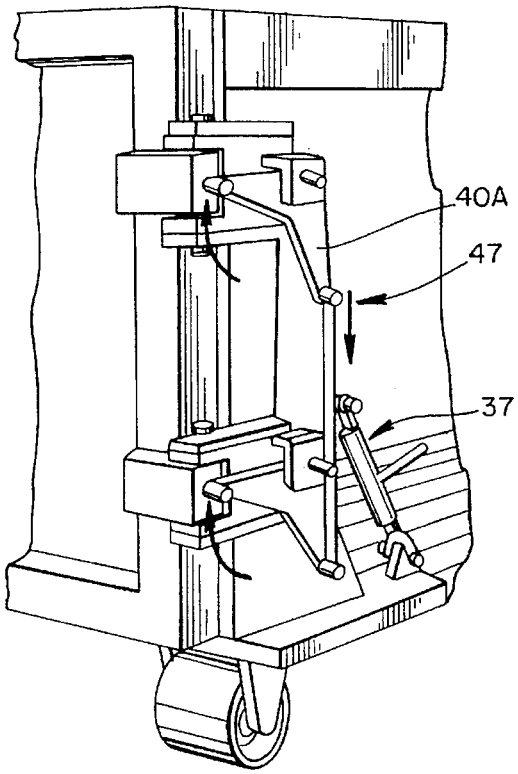
FIG. 9 is a partial, enlarged perspective view of the right sidewall of the waste container and the associated conventional side door latch mechanism shown in FIGS. 1 and 8.

Referring to FIGS. 8 and 9, door 20 can be opened by pivotal rotation about hinges 35. After closing, door 20 can be latched using (conventional) right-side door latching mechanism 47. As shown, ratchet-type turnbuckle 37 can be extended or retracted to control the movement of triangular hinge locking plates 40A. When turnbuckle 37 is retracted, triangular plates 40A are rotated clockwise until they are in the position shown in FIG. 9. Now, the rear-most edge of triangular plates 40A blocks further pivotal rotation of hinges 35, preventing opening of the rear door.

Figure 10:
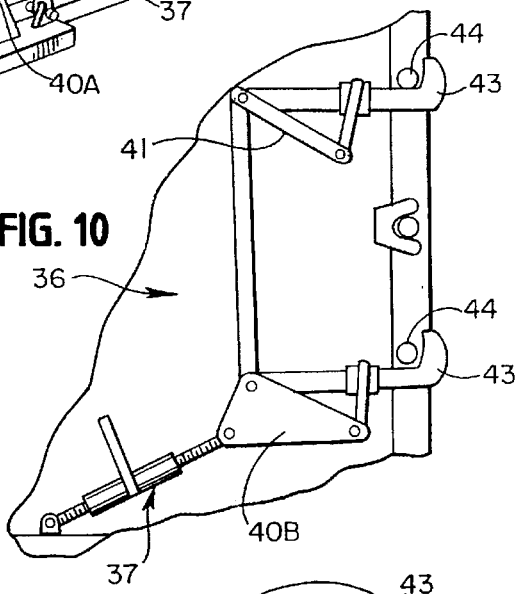
FIGS. 10 and 11 are partial, enlarged side views of the left sidewall of the waste container shown in FIG. 8, together with the associated conventional side door latch assembly, taken along section line 10—10 of FIG. 8.
Figure 11:
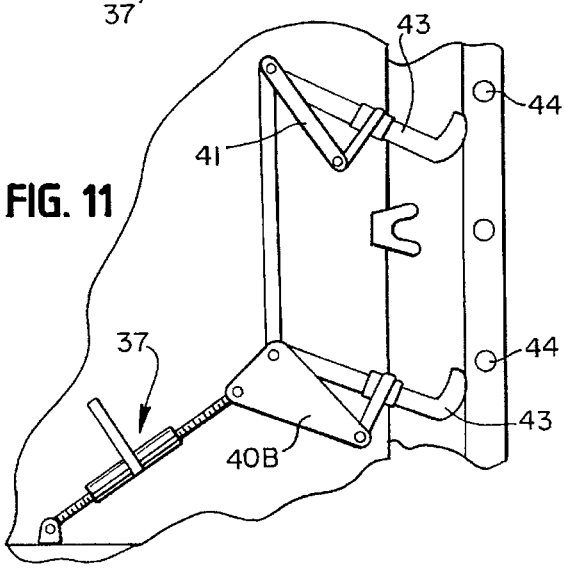

Referring now to FIGS. 8, 10 and 11, the operation of left-side (conventional) door latching mechanism 36 will now be described. Extension of turnbuckle 37 causes a clockwise rotation of triangular plate 40B and link 41. This releases locking bar 43 from operable engagement with locking pin 44 on door 20, as shown in sequential relation in FIGS. 10 and 11.

As will be appreciated by those of skill in the art, the use and function of a device such as ratchet-type turnbuckle 63 has long been known. Referring to FIGS. 2 and 3, turnbuckle 63 includes threaded bars 63A rigidly connected at remote opposing ends to door 20 as shown, and connected at adjacent ends to ratchet wheel 63B, which includes inclined teeth (not shown). Ratchet wheel 63B can be rotated, using crank arm 67, in one effective direction only, depending on which way a pawl (not shown) is dropped, to permit the selective extension or retraction of threaded bars 63A.

Figure 4:
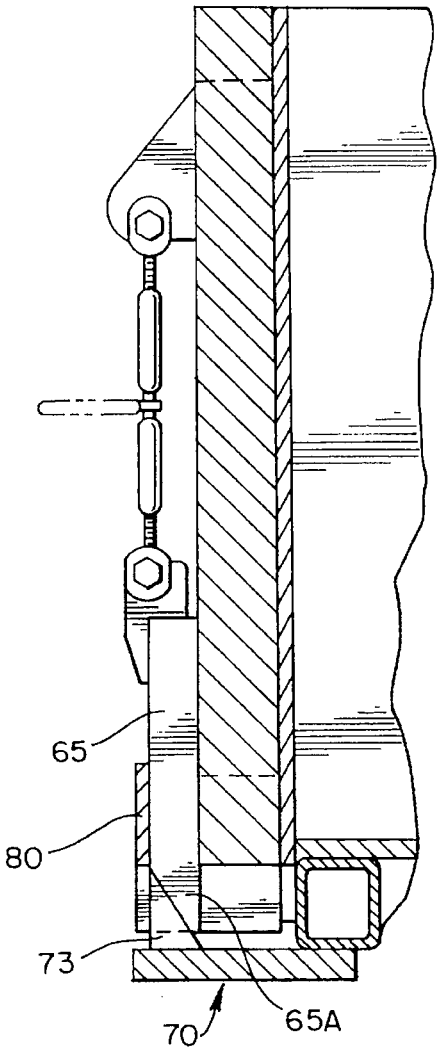
FIG. 4 is an enlarged side view of an alternative embodiment of the door latch and sealing assembly according to the present invention.
Figure 5:
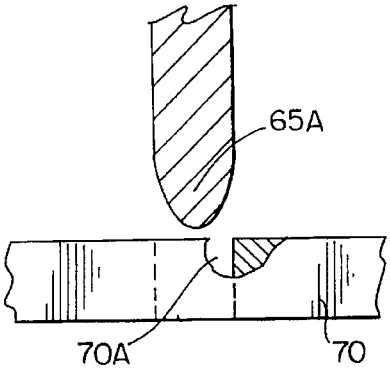
FIG. 5 is an enlarged view of the distal portion of an alternative embodiment of the seal actuator of the present invention.

Referring to FIG. 4, an alternative embodiment of the door latch and sealing assembly of the present invention is shown. In this embodiment, receiver 70 terminates in an upwardly angled portion 73, and seal actuator 65 includes an angled distal end 65A which is preferably tapered for mating engagement with angled portion 73 of receiver 70. As shown, steel guide 80 need not enclose seal actuator 65, but need only abut one side of seal actuator 65 to stabilize it.

Figure 7:
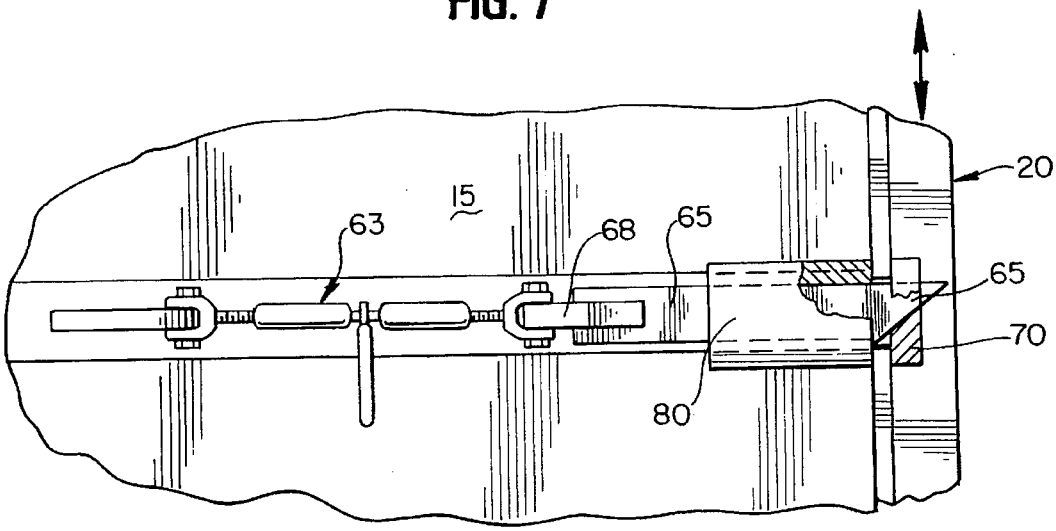
FIG. 7 is a partial, enlarged front view of an alternative embodiment of the door latch and sealing assembly of the present invention, illustrating its use with a vertically sliding door.

Referring to FIG. 7, another alternative embodiment of the door latch and sealing assembly of the present invention is shown. In this embodiment, door 20 is slid open in a vertically upward direction. Turnbuckle 63 and seal actuator 65 are rigidly connected to container sidewall 15. Receiver 70 is rigidly connected to door 20. Extension of turnbuckle 63 moves seal actuator 65 toward door 20, and within receiver 70. Further extension of turnbuckle 63 causes distal portion 65A of seal actuator 65 to press against receiver 70, thereby exerting a downward reactive force on door 20. Another door latch mechanism (not shown) could be used, if desired, to force door 20 down against sidewall 15.

Figure 12:
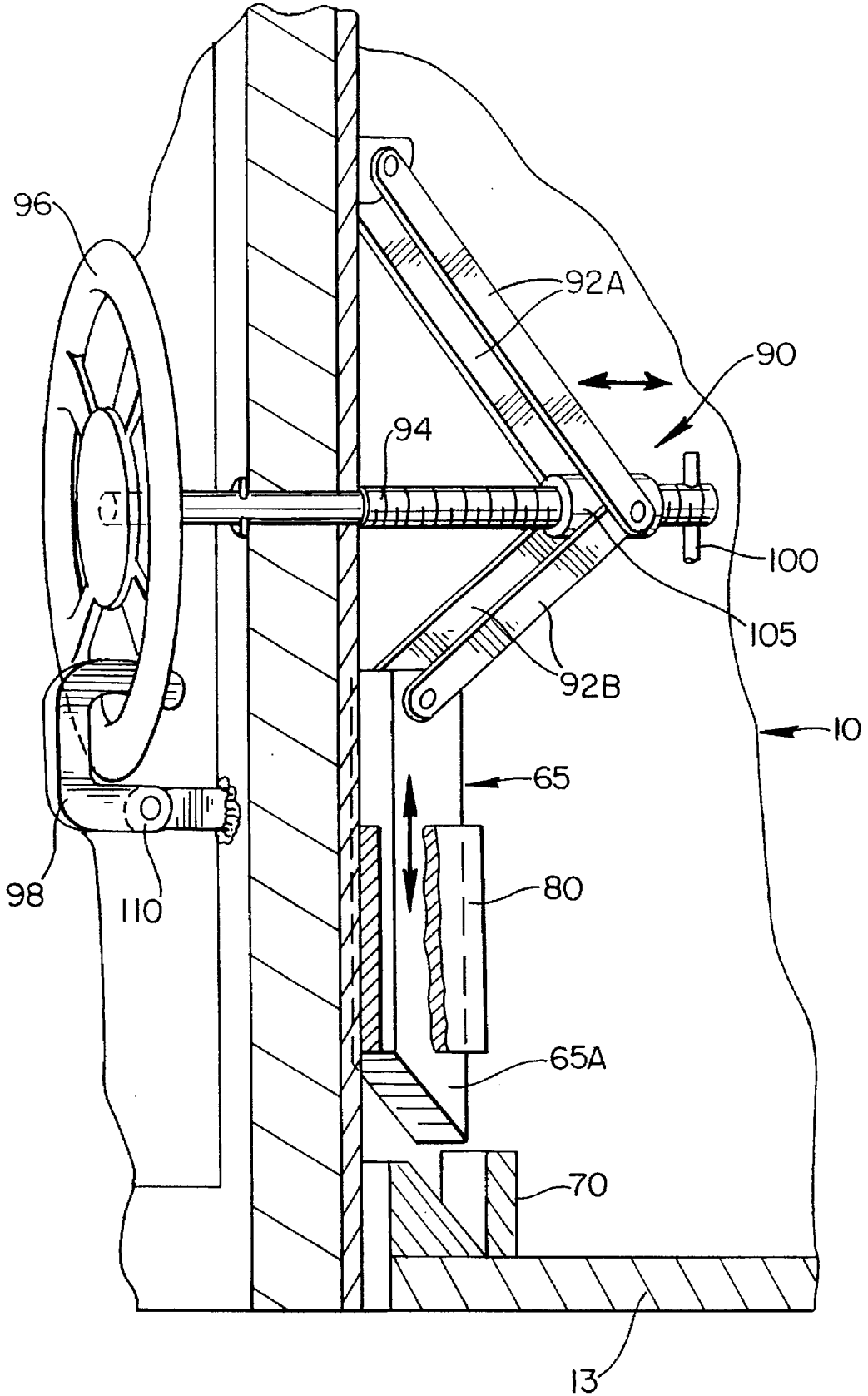
FIG. 12 is a side cross-sectional view of an alternative embodiment of the door latch and sealing assembly of the present invention.

In still another alternative embodiment, shown at FIG. 12, a door latch and sealing assembly according to the present invention is located inside waste container 10. In this embodiment, seal actuator 65 can be moved vertically by first disengaging hook 98 (pivotable about pin 110), and then rotating wheel 96. Rotation of wheel 96 causes threaded collar 105 to move horizontally along threaded bar 94. This horizontal movement of collar 105, in turn, causes a corresponding extension or retraction of links 92A and links 92B; movement of links 92A and 92B drives seal actuator 65. (This extension will cease when the connecting portion of links 92A and links 92B contacts pin 100.) Receiver 70 is located above and rigidly connected to floor 13 within container 10. Seal actuator 65 and receiver 70 operably engage and function in the manner earlier described, to provide a liquid-tight door seal.

Of course, it should be understood that various changes and modifications to the preferred embodiments described herein will be apparent to those skilled in the art. For example, the wheel-type seal actuator drive mechanism shown at FIG. 12 could be used in conjunction with any of the various embodiments of the present invention described here. Also, other known mechanical devices not described here, which might even be controlled pneumatically, fluidically, or electrically, could serve as a seal actuator drive mechanism for use in the present invention. Such changes and modifications can be made without departing from the spirit and scope of the present invention and without diminishing its attendant advantages. It is, therefore, intended that such changes and modifications be covered by the following claims.

I claim:

1. A waste container with a door latch and sealing assembly, the waste container having a floor, two opposing sidewalls, an open end defined by a continuous edge portion, and at least one door positioned adjacent to and completely overlying the open end, comprising:

at least one seal actuator positioned adjacent to the door;

a receiver rigidly attached to the container in a fixed position and adapted for operable engagement with the seal actuator;

at least one seal actuator drive mechanism in mechanical cooperation with the seal actuator and adapted to impart a force to the seal actuator that is generally parallel to the length of the door and to drive the seal actuator in a linear direction to engage the receiver;

a continuous elastomeric gasket positioned between the edge portion of the open end and the door, the gasket being capable of forming a liquid-tight seal of the door against the container upon the application of a sufficient compressive force to the door in the direction of the open end;

whereby movement of the seal actuator drive mechanism causes the seal actuator to engage the receiver, and the receiver reactively imparts to the seal actuator the compressive force on the door sufficient to establish the liquid-tight seal, the receiver remaining in the fixed position during exertion of the compressive force on the door, or during opening or closing of the door.

2. The waste container with door latch and sealing assembly of claim 1, wherein the seal actuator is tapered.

3. The waste container with door latch and sealing assembly of claim 2, wherein the tapered seal actuator includes a proximal portion having a width and a substantially uniform cross-section, and a tapered distal end portion.

4. The waste container with door latch and sealing assembly of claim 3, wherein the receiver has first and second opposing sides defining a width which is less than the width of the proximal portion of the seal actuator.

5. The waste container with door latch and sealing assembly of claim 1, wherein the tightness of the seal of the door against the container can be adjustably controlled.

6. The waste container with door latch and sealing assembly of claim 1, wherein the seal actuator drive mechanism is rigidly attached to the container.

7. The waste container with door latch and sealing assembly of claim 1, wherein the seal actuator drive mechanism is rigidly attached to the door.

8. The waste container with door latch and sealing assembly of claim 1, wherein a sufficient extension of the seal actuator drive mechanism results in a hermetic seal of the door against the container.

9. The waste container with door latch and sealing assembly of claim 1, wherein the gasket is composed of a compressible neoprene sponge.

10. The waste container with door latch and sealing assembly of claim 1, wherein the gasket is capable of passing a compression test in which it is placed under a 25% deflection during heating at 158° F. for 22 hours, and after a one-half hour recovery period the compression set of the gasket is less than 50%.

11. The waste container with door latch and sealing assembly of claim 1, wherein the gasket is capable of passing a low temperature brittleness test in which it is aged for 5 hours at an air temperature of −40° F., and no visible cracks in the gasket occur.

12. The waste container with door latch and sealing assembly of claim 1, wherein the gasket is capable of passing a water absorption test in which 18-inch gasket specimens are immersed for a period of 24 hours in distilled water at a temperature of 73° F., and the weight change of each gasket specimen is less than 3%.

13. The waste container with door latch and sealing assembly of claim 1, wherein the gasket is attached to one side of the door by the use of a flexible gasket adhesive which has a specific gravity less than 1, a vapor density greater than 1, and is substantially insoluble in water.

14. The waste container with door latch and sealing assembly of claim 1, further comprising means for latching the door at the sides of the door adjacent the sidewalls of the container.

15. The waste container with door latch and sealing assembly of claim 1, wherein the seal actuator drive mechanism includes a turnbuckle which can be incrementally extended, causing the seal actuator to exert an incrementally increasing force on the receiver to adjustably seal the door against the container.

16. The waste container with door latch and sealing assembly of claim 1, wherein the seal actuator drive mechanism includes a wheel drive mechanism whereby rotation of a wheel serves to drive movement of the seal actuator in a desired direction.

17. The waste container with door latch and sealing assembly of claim 1, wherein the seal actuator moves in a linear direction to engage the receiver.

18. A waste container with a door latch and sealing assembly, the waste container having an open end circumscribed by a continuous edge portion and at least one door positioned adjacent to and completely overlying the open end, comprising:

a tapered seal actuator positioned adjacent to the door;

a receiver rigidly attached to the container in a fixed position and adapted for operable engagement with the seal actuator;

a seal actuator drive mechanism in mechanical cooperation with the seal actuator and adapted to impart a force to the the seal actuator that is generally parallel to the length of the door to drive the seal actuator in a linear direction to engage the receiver;

a compressible elastomeric sealing material positioned between the edge portion of the open end and the door, the sealing material being capable of forming a liquid-tight joint between the door and the container upon the application of a sufficient compressive force to the door in the direction of the open end;

whereby movement of the seal actuator drive mechanism causes the seal actuator to move in a linear direction to engage the receiver, generating the necessary compressive force on the door to establish the liquid-tight joint, the receiver remaining in the fixed position during exertion of the compressive force on the door, or during opening or closing of the door.

19. The waste container with door latch and sealing assembly of claim 18, wherein the seal actuator and the receiver are positioned on the inside of the container.

20. A waste container with a door latch and sealing assembly, the waste container having an open end defined by a continuous edge portion and at least one door positioned adjacent to and completely overlying the open end, comprising:

a seal actuator including a tapered distal end, the seal actuator being positioned adjacent to the door;

a receiver rigidly attached to the container in a fixed position and adapted for operable engagement with the seal actuator;

seal actuator drive means in mechanical cooperation with the seal actuator and adapted to impart a force to the seal actuator that is generally parallel to the length of the door, to drive the seal actuator in a linear direction and thereby engage the receiver;

a compressible elastomeric sealing material positioned between the edge portion of the open end and the door, the sealing material being capable of forming a liquid-tight joint between the door and the container upon the application of a sufficient compressive force to the door in the direction of the open end;

whereby the seal actuator drive means causes the seal actuator to engage the receiver, and the resulting reactive force generates the necessary compressive force on the door to establish the liquid-tight joint, the receiver remaining in the fixed position during exertion of the compressive force on the door, or during opening or closing of the door.

21. The waste container with door latch and sealing assembly of claim 20, wherein the receiver includes a recess, and extension of the seal actuator drive means causes the tapered distal end of the seal actuator to enter the recess.

* * * * *